United States Patent [19]

Oxenrider et al.

[11] Patent Number: 4,959,248

[45] Date of Patent: Sep. 25, 1990

[54] PROCESS FOR IMPARTING STAIN RESISTANCE TO FIBERS AND TO ANTI-STAINING AGENTS FOR USE IN THE PROCESS

[75] Inventors: Bryce C. Oxenrider, Florham Park; Frederick R. Hopf, Parsippany, both of N.J.;

[73] Assignees: Allied-Signal, Morris Township, Morris County, N.J.;

[21] Appl. No.: 123,406

[22] Filed: Nov. 20, 1987

[51] Int. Cl.[5] ..... D02G 3/00

[52] U.S. Cl. ..... 427/385.5; 427/385.5; 427/393.5; 8/115.6; 8/115.65; 8/DIG. 21

[58] Field of Search ..... 8/115.6, 115.65, 560, 8/495; 428/96; 427/385.5, 393.5, 389.9

[56] References Cited

U.S. PATENT DOCUMENTS

| | | | |
|---|---|---|---|
| 4,192,754 | 3/1980 | Marshall et al. | 252/8.8 |
| 4,501,590 | 2/1985 | Suzuki et al. | 8/495 |
| 4,501,591 | 2/1985 | Ucci et al. | 8/495 |

*Primary Examiner*—Paul Lieberman
*Assistant Examiner*—John F. McNally
*Attorney, Agent, or Firm*—R. C. Stewart II; G. H. Fuchs; E. D. Buff

[57] ABSTRACT

This invention relates to novel compositions for imparting stain resistance to fibers, which composition comprises a phenolic or naphtholic resin.

37 Claims, No Drawings

PROCESS FOR IMPARTING STAIN RESISTANCE TO FIBERS AND TO ANTI-STAINING AGENTS FOR USE IN THE PROCESS

FIELD OF THE INVENTION

This invention relates to a process for imparting stain resistance to fibers and to fibers treated in accordance with the process. This invention also relates to compositions for use in such a process. More particularly, this invention relates to such a process in which the fibers are treated with a condensation product, and to compositions comprising such a product.

PRIOR ART

Polyamide carpet is a popular floor covering for both residential and commercial applications. Such carpeting is relatively inexpensive and offers a desirable combination of qualities such as aesthetics, comfort, safety, warmth and quietness. Also, it is available in a wide variety of attractive colors, patterns and textures. Carpet fibers are subjected to soiling and staining due to normal usage. For example, polyamide carpet is permanently stained by certain artificial and natural colorants, for example, colorants present in coffee, red wine and soft drinks. One such colorant is FD&C Red Dye No. 40, a dye federally approved for human consumption and commonly used in foods and beverages, such as soft drink packaged premixes and gelatin desserts, for the purposes of imparting a red color to such foods and beverages.

In addition, tramp dirt is deposited on the carpet from shoe soles. While in most cases the dirt can be removed by vacuuming and occasional steam cleaning, some staining can occur. These stains may not be readily removed by normal cleaning methods, and a carpet fiber that is not susceptible to stains would be very desirable. The usual commercial approach to minimizing staining of polyamide carpet has been to coat the polyamide fiber surfaces, either before or after the carpet is made, with a fluorochemical which prevents wetting of the carpet surface and thus minimize contact between the staining substance (i.e. colorant) and the carpet surface. This approach, however, offers very little protection to the carpet in instances where the staining substance is not immediately removed from the carpet.

Surveys of the carpet replacement market show that more carpets are replaced due to staining than due to wear. Therefore, there is a need in the art to provide a stain resistant polyamide carpet having the ability to retain its original appearance for a longer period of time. Recently, some commercial products have been used to increase stain resistance of fibers. These materials are applied to the fiber after dyeing the carpet or fabrics as a separate step and are called dye resistants. Examples of these materials are Mesitol PS, Mesitol NBS and INTRATEX N. Other such processes are described in U.S. Pat. No. 4,501,590, which describes treatment of the fiber with a liquor containing a silicate of the formula $M_2O_mSiO_2$ where M is an alkali metal and m is a number ranging from about 0.5 to 2, and either a sulfonated napthol-formaldehyde condensation product or a sulfonated phenol-formaldehyde condensation product.

SUMMARY OF THE INVENTION

This invention relates to a process for imparting stain resistance to a fiber which comprises the steps of:

a. treating a polyamide or polyester fiber with a composition comprising an acceptable carrier and an effective amount of one or more condensation products of the Formula I:

$$P—Z—X\left[Z—X\right]_n Z—P; \qquad \text{Formula I}$$

b. annealing said treated fiber;

wherein:

Z is a divalent moiety selected from the group consisting of:

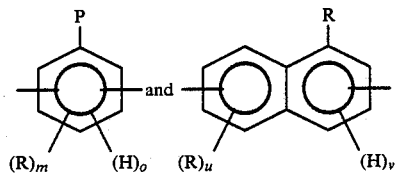

P is hydrogen, —OH or a moiety of the formula —X—OH:

n is a positive whole number greater than or equal to 1;

m and o are the same or different at each occurrence and are positive whole numbers from 0 to 3, with the proviso that the sum of m and 0 is 3;

u and v are the same or different at each occurrence and are positive whole numbers from 0 to 5 with the proviso that the sum of u and v is 5;

X— is a divalent organic radical; and

R is the same or different at each occurrence and is a substituent other than hydrogen.

This invention also relates to fibers treated in accordance with the process of this invention, as well as to compositions comprising an acceptable carrier and an effective amount of one or more of the above-identified condensation products which composition may optionally include one or more other fiber treating materials such as dyes, anti-staining agents, and the like.

Fibers treated in accordance with this invention exhibit stain resistance properties. The imparted stain resistance is stable to repeated laundering.

DESCRIPTION OF THE PREFERRED EMBODIMENTS OF THIS INVENTION

The process of this invention includes two essential steps. The first essential step of the process of this invention comprises treating polyester or polyamide fibers with the composition of this invention. The method employed to treat the fiber may vary widely, and any conventional fiber treating procedure may be employed. For example, the fiber can be sprayed with an emulsion, suspension or like composition containing one or more of the condensation products at any point during the fiber treating process. For example, the fiber can be sprayed, before, during or after dyeing, or before, during or after application of other surface treating materials. Still other conventional fiber treating procedures can be used, such as dipping, and the like. The fiber may be subjected to a single treatment step or multiple treating steps may be employed.

Compositions for use in practice of this invention comprise an acceptable carrier and an effective amount of one or more condensation products of the following formula:

$$P—Z—X\left[Z—X\right]_{u}Z—P$$

wherein —X—, n, P, R, m, Z, u, v, and o are as defined above.

In the above structural formula, —X— is a divalent organic radical. Illustrative of suitable —X— groups are alkylene groups such as methylene, ethylmethylene, 2-ethylpentylmethylene, methylmethylene, isopropylmethylene, isobutylmethylene, pentylmethylene, furylmethylene, and the like; arylenes such as 1,3-benzenedimethylene, phenylmethylene, 1,4-benzenedimethylene, 2,2-bis-(4-phenylene)propane, 4-methoxyphenylmethylene, bis-(4-phenylene)methane, 4,4-diphenylene dimethylethane, and the like; and cycloalkylenes such as cyclohexylene, cyclooctylene, 1,3-cyclohexanedimethylene, and the like.

In the above structural formula, R is a substituent other than hydrogen. Illustrative of suitable R groups are such substituents as alkyl, aryloxy, alkoxy, aryl, hydroxyl, methylol, and the like.

In the preferred embodiment of the invention, the material is a phenolic condensation product of the formula:

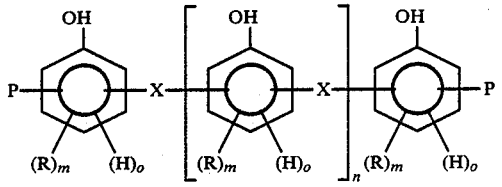

wherein:

n, P, R, m, o, and —X— are as defined above. Amongst these preferred phenolic condensation products preferred are those in which:

—X— is substituted or unsubstituted methylene or substituted 1,4-phenyldimethylene;

m and o are the same or different at each occurrence and are positive whole numbers from 0 to 3, with the proviso that the sum of m and o is 3;

R is the same or different at each occurrence and is alkyl having from 1 to about 8 carbon atoms, phenyl, alkylphenyl having from 7 to about 10 carbon atoms, hydroxyl, halogen, or methylol;

n is a positive number of from 1 to 20; and

P is the same or different at each occurrence and is hydrogen or methylol.

In the particularly preferred embodiments of the invention containing the phenolic condensation product.

—X— is methylene, methylene substituted with alkyl having from about 1 to 10 carbon atoms, furfuryl or xylene;

R is the same or different at each occurrence and is alkyl having from 1 to about 6 carbon atoms;

m is 0 or 1;

n is 1 to about 15;

P is hydrogen; and o is 2 or 3.

Amongst these particularly preferred embodiments containing the phenolic decomposition product, most preferred are those embodiments wherein:

n is 1 to about 10;

m is 0 or 1;

o is 2 or 3

R is methyl;

—X— is a moiety of the formula:

$$—CHR_1—$$

where $R_1$ is hydrogen or lower alkyl, preferably hydrogen; and

P is hydrogen.

In general, the composition comprises an "effective amount" of one or more of the condensation products of Formula I. As used herein, an "effective amount" of the products is an amount which is sufficient to improve the anti-staining characteristics of the fiber to any extent when the fiber is treated with the composition. The amount of condensation product included in the composition may vary widely and will depend on the degree of protection desired. In general, under similar process conditions, the higher the concentration of the products in the composition, the greater the degree of improvement in the anti-staining characteristics of the fiber. Conversely, under similarly used conditions, the lower the concentration of the products in the composition, the lower the degree of improvement in the anti-staining characteristics of the fiber. Usually, the amount of condensation products contained in the composition is at least about 0.01 percent by weight based on the total weight of the product and carrier. In the preferred embodiments of this invention, the amount of condensation products contained in the composition is from about 0.01 to about 10.0 percent by weight based on the total weight of the condensation products; and in the particularly preferred embodiments of the invention, the amount of condensation products contained in the composition is from about 0.02 to about 5.0 percent by weight on the aforementioned basis. Amongst these particularly preferred embodiments, most preferred are those embodiments in which the amount of condensation product contained in the composition is from about 0.05 to about 1.0 percent by weight based on the total weight of the product and carrier.

The composition also includes an "acceptable carrier". As used herein, an "acceptable carrier" is a liquid diluent which is capable of forming a solution, dispersion, emulsion or like liquid composition comprising an effective amount of the condensation products. Useful liquid diluents include water and organic solvents. Illustrative of suitable organic solvents are ketones and aldehydes such as acetone, methyl ethyl ketone, acetaldehyde, propionaldehyde, n-butyraldehyde, heptaldehyde, methylisobutyl ketone, 2-pentanone, 3-pentanone, 2-hexanone, 3-hexanone, 2-pentanone, 3-pentanone, and the like; linear and cyclic ethers such as tetrahydropyran, tetrahydrofuran, dimethyl tetrahydrofuran, dioxane, methyl ethyl ether, ethyl tertbutyl ether, n-butyl ether, methyl ether, ethyl ether, n-propyl ether, isopropyl ether, and the like; organic carbonates such as propylene carbonate; ethylene carbonate, and the like; low molecular weight alcohols such as methanol, n-propanol, ethanol, isopropanol, n-butanol, n-pentanol, n-heranol, n-heptanol, and the like; and organic esters such as methyl ethyl ester, ethyl butyl ester, ethyl acetate, n-propylacetate, benzyl acetate, n-butyl acetate, isopentyl acetate, ethyl formate, ethyl propionate, ethyl n-butyrate, ethyl valerate; and the like.

The compositions may also include other optional ingredients as for example surfactants, emulsifiers to aid in the dispersal of the condensation products in the composition. The type of surfactant, emulsifier or the like dispersing aid employed is not critical and can be varied widely. Useful surfactants may be amphoteric, anionic, cationic or nonionic in nature, or a combination of such surfactants can be employed. Useful surfactants, emulsifiers, and the like are well known in the art. For example, useful surfactants are described in publications such as Schwartz, A. M.; and J. W. Perry, "Surface Active Agents," 3d. Ed., Interscience-Wiley, N.Y., 1949; Shinola, Ozo, et al. "Colloidal Surfactants," Academic, N.Y., 1963; Jungormann, Eric, "Cationic Surfactants," Dekker, N.Y., 1970; Sishey, J. P.: "Encyclopedia of Surface Active Agents," Chemical Publishing Company, New York; and Dombrow, B. Sulfated Fats and Oils, Chap. 8 in W. M. Linfield (ed.), "Anionic Surfactants," Marcel Dekker, N.Y., 1973. Accordingly, such dispersing acids will not be described herein in any great detail. In general, the amount of one or more surfactants contained in the solution is at least about 0.001 percent by weight based on the total weight of the solution. The upper limit to the amount of surfactants is not critical, and is dictated primarily by economic considerations. In the preferred embodiments of the invention, the amount of the surfactant contained in the solution is from about 0.0001 to about 20 percent by weight based on the total weight of the solution, and in the particularly preferred embodiments of the invention, the amount of the surfactant is from about 0.0001 to about 10 percent by weight on the same bases. Amongst these particularly preferred embodiments of the invention, most preferred are those embodiments in which the amount of said one or more surfactants in said solution is from about 0.01 to about 1 percent by weight based on the total weight of the solution.

The composition may also include one or more other fiber-treating agents, which may be used to treat the fiber in one or more treatment steps. The amount of other fiber-treating agents contained in the composition will vary widely. In general, compositions may include any of such other agents or may include amounts known in the art for use with such agents. In addition, the fiber may be treated with the composition of this invention in one treatment step, followed by treatment with one or more other compositions containing one or more of the other fiber treating agents in one or more other treatment steps. Conversely, the fiber can be first treated with these other compositions containing the other fiber treating agents followed by treatment with the composition of this invention. In any event, the treated fiber should have the desired surface properties of each of the treating agents. In the preferred embodiments of the invention, the fiber is treated with a single composition containing the desired fiber treating agents in a single step or in multiple steps. Surprisingly, it has been discovered that when the agent of this invention is employed in combination with other fiber surface treating agents a stabilized fiber surface which the desired surface characteristics of each agent results which is resistant to successive laundering. Illustrative of such fiber-treating agents are the anti-soiling additives described in U.S. Pat. Nos. 4,252,982; 4,321,403; 4,192,754; 4,134,839; 4,190,545; 4,193,880; 4,283,292; 4,317,736; 3,171,861; 3,514,587; 3,547,861; 4,209,610; 4,446,306; 3,547,861 and 4,414,277. Useful fiber-treating agents also include those described in British Patent No. 1,543,081.

In the preferred embodiments, the condensation products are applied in conjunction with other fiber-treating additives either in the same composition, in the same treatment step or in individual compositions in different treatment steps. In the particularly preferred embodiments, the condensation products are applied together with anti-soiling agent of U.S. Pat. Nos. 4,414,277; 4,209,610 and 4,446,306. In the most preferred embodiments of the invention, the condensation products are applied together with the anti-soiling agent of U.S. Pat. No. 4,209,610. Surprisingly, we have discovered that use of these various components in combination results in a stabilized fiber surface which exhibits both anti-staining and anti-soiling properties after successive laundering.

The amount of anti-staining agent of this invention applied to the fiber surface will vary depending on the degree of protection desired. In general, the greater the amount of agent on the surface, the greater the degree of protection; and conversely, the lessor the amount of agent on the fiber surface, the lessor the degree of properties. Usually, the amount of agent applied to the fiber is at least about 0.01 percent by weight based on the weight of the fiber. In the preferred embodiments of the inventions, the amount of agent applied to the fiber is from about 0.01 to about 10.0 percent by weight of the fiber, and in the particularly preferred embodiments is from about 0.05 to about 5.0 percent by weight on the aforementioned basis. In the most preferred embodiments of this invention, the amount of agent applied to the fiber is from about 0.1 to about 2.0 percent by weight based on the total weight of the fiber with an amount of from about 0.1 to about 1.0 percent by weight on the aforementioned basis, the lesser amount being the amount of choice.

Fibers for use in the practice of this invention are composed of polyester and polyamides. Illustrative of polyamides are synthetic linear polycarbonamides characterized by the presence of recurring carbonamide groups as an integral part of the polymer chain which are separated from one another by at least two carbon atoms. Polyamides of this type include polymers, generally known in the art as nylons, having the recurring unit represented by the general formula:

$$-NHC(O)R_2(O)R_3$$

and $$-C(O)R_4NH-$$

in which $R_2$ is an alkylene group of at least two carbon atoms, preferably from about 2 to about 10; and $R_3$ and $R_4$ are selected from $R_2$, phenylene and cycloalkylene. Useful polyamides include those which are obtained by condensation of diamines and dibasic acids and those which are obtained by self-condensation of aminoacids and cyclized derivatives thereof. Also included are copolyamides and terpolyamides obtained by known methods, as for example, by condensation of hexamethylene diamine and a mixture of dibasic acids consisting of terephthalic acids and derivatives thereof, as for example, lactams.

Polyamides of the above description are well known in the art and include, for example, the copolyamide of 30% hexamethylene diammonium isophthalate and 70% hexamethylene diammonium adipate, the copolyamide of up to 30% bis-(p-amidocyclohexyl)methylene, and terephthalic acid and caprolactam, poly(hexamethyleneadipamide) (nylon 66), poly(4-aminobutyric acid) (nylon 4), poly(7-aminoheptanoic acid) (nylon 7), poly(8-aminooctanoic acid) (nylon 8), poly(6-aminohexanoic acid) (nylon 6), poly(hexamethylene sebacamide) (nylon 6,10), poly(heptamethylene pimelamide) (nylon 7,7), poly(octamethylene superamide) (nylon 8,8), poly(hexamethylene sebacamide) (nylon 6,10) poly(nonamethylene azelamide) (nylon 9,9), poly(-decamethylene azelamide) (nylon 10,9), poly(-decamethylene sebacamide (nylon 10,10), poly[bis(4-aminocyclohexyl)methane-1,10-decanedicarboxamide] ((Qiana) (trans)), poly(m-xylylene adipamide), poly(p-xylylene sebacamide), poly(2,2,2-trimethylhexamethylene terephthalamide), poly(piperazine sebacamide), poly(metaphenylene isophthalamide) (Nomex), poly(p-phenylene terephthalamide) (Kevlar), poly(11-aminoundecanoic acid) (nylon 11) poly(12-aminododecanoic acid) (nylon 12), polyhexamethylene isophthalamide, polyhexamethylene terephthalamide, poly(9-aminononanoic acid) (nylon 9) polycaproamide, or combinations thereof. The polyamide for use in the most preferred embodiments of this invention is polycapralactam which is commercially available from Allied Corporation under Capron Nylon.

Other polymers which may be employed in the process of this invention are linear polyesters. The type of polyester is not critical and the particular polyester chosen for use in any particular situation will depend essentially on the physical properties and features, i.e. tensile strength, modulus, and the like, desired in the final fiber. Thus, a multiplicity of linear thermoplastic polyesters having wide variations in physical properties are suitable for use in the process of this invention.

The particular polyester chosen for use can be a homo-polyester or a co-polyester, or mixtures thereof as desired. Polyesters are normally prepared by the condensation of an organic dicarboxylic acid and an organic diol, and, therefore, illustrative examples of useful polyesters will be described hereinbelow in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids and may be cycloaliphatic, aliphatic or aromatic polyesters.

Exemplary of useful cycloaliphatic, aliphatic and aromatic polyesters which can be utilized in the practice of their invention are poly(ethylene terephthalate), poly(cyclohexylenedimethylene, terephthalate), poly-(ethylene dodecate), poly(butylene terephthalate, poly[ethylene(2,7-naphthalate)], poly(metaphenylene isophthalate), poly(glycolic acid), poly(ethylene succinate), poly(ethylene adipate), poly(ethylene sebacate), poly(decamethylene azelate), poly(ethylene sebacate), poly(decamethylene adipate), poly(decamethylene sebacate)m polyα, α-dimethylpropiolactone), poly(-para-hydroxybenzoate) (Ekonol), poly(ethylene oxybenzoate) (A-tell), poly(ethylene isophthalate), poly(-tetramethylene terephthalate, poly(hexamethylene terephthalate), poly(decamethylene terephthalate), poly(1,4-cyclohexane dimethylene terephthalate) (trans), poly(ethylene 1,5-naphtholate), poly(ethylene 2,6-naphtholate), poly(1,4-cyclohexylidene dimethylene terephthalate) (Kodel) (cis), and poly(1,4-cyclohexylidene dimethylene terephthalate (Kodel) (trans).

Polyester compounds prepared from the condensation of a diol and an aromatic dicarboxylic acid are preferred for use in this invention. Illustrative of such useful aromatic carboxylic acids are terephthalic acid, isophthalic acid and an o-phthalic acid, 1,3-naphthalenedicarboxylic acid, 1,4-naphthalenedicarboxylic acid, 2,6-naphthalenedicarboxylic acid or 2,7-naphthalenedicarboxylic acid, 4,4'-diphenyldicarboxylic acid, 4,4'-diphenysulphone-dicarboxylic acid, 1,1,3-trimethyl-5-carboxy-3-(p-carboxyphenyl)-indane, diphenyl ether 4,4'-dicarboxylic acid, bis-p(carboxyphenyl)methane, and the like. Of the aforementioned aromatic dicarboxylic acids based on a benzene ring such as terephthalic acid, isophthalic acid, orthophthalic acid are preferred for use and amongst these preferred acid precursors, terephthalic acid is particularly preferred.

In the most preferred embodiments of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

In the preferred embodiments of the invention, the polymer of choice are polyesters, polyamides blends containing polyesters, and blends containing polyamides, and in the particularly preferred embodiments of the invention polyamides or polyamide blends are used. Amongst these particularly preferred embodiments most preferred are those embodiments in which the polyamide is nylon 6 or nylon 66.

Treatment times are not critical and may vary widely. In general, the fiber is treated for a time sufficient to provide the desired anti-staining protection. Usually, treatment times will vary from about 1 or 2 seconds up to about 30 minutes.

Treatment temperatures and pressures are also not too critical and may vary widely. Room temperatures and atmospheric pressures are preferred because of convenience.

In the second step of the method of this invention, the treated fiber is annealed. The effectiveness of the anti-staining properties of the condensation products can be enhanced by an annealing operation at temperatures above the glass transition temperatures of the polyamides and/or polyesters forming the fiber, and below the degradation temperatures of the polyamides and/or polyesthers and the anti-staining agent. Annealing temperatures thus will vary widely depending on a number of factors such as the polymer forming the fiber, the agent of choice and other factors known to those of skill in the art. In general, annealing temperatures will vary from about 50° C. to about 250° C. Preferred annealing temperatures are from about 70° C. to about 185° C., and particularly preferred annealing temperatures are from about 85° C. to about 170° C. Amongst these particularly preferred embodiments, most preferred are those embodiments in which annealing temperatures are from about 100° C. to about 150° C.

Annealing times may vary widely. Annealing times employed are those which are sufficient to achieve the desired enhancement in anti-staining properties. In general, the higher the annealing temperature, the shorter the annealing times required to provide the desired level of anti-staining properties, and, conversely, the lower the annealing temperature, the longer the annealing times required to provide a given level of anti-staining protection. Suitable periods for each annealing may range from about 10 seconds to about 1 hour when employing the preferred condition of this invention. Particularly, preferred annealing times are from about 30 seconds to about 30 minutes and most preferred annealing times are from about 35 seconds to about 10 minutes.

Fibers treated in accordance with this invention exhibit improved anti-staining properties with continued laundering. These fibers are useful for a number of purposes including use in the manufacture of carpets.

following specific examples are presented to more particularly illustrate the invention and should not be considered limitations thereon.

EXAMPLE I

A stock solution of 3.0 g of bis(3-hydroxy-2-chloropropyl)-diperfluoroalkylethyltetra ester of pyromelletic acid ("DSR") in isopropanol was prepared. Various test solutions were formulated using 50 ml aliquots of the stock solution and 50 ml of a methanol solution containing various amounts of a novolac manufactured and sold by Bendix Friction Materials Division under the tradename novolac RD-27 ("RD-27"), hexamethylenetetraamine ("HMTA") and a dye resist manufactured and sold by Crompton-Knowles under the tradename Intratex ("Intratex"). The test solutions are set forth in the following Table I.

TABLE I

| Test sol. | DSR (g) | DMU* | RD 27 (g) | HMTA (g) | Intratex (g) |
|---|---|---|---|---|---|
| 1 | 0.25 | — | — | — | — |
| 2 | 0.25 | — | 0.4 | — | — |
| 3 | 0.25 | — | 0.2 | — | — |
| 4 | 0.25 | — | 0.2 | 0.1 | — |
| 5 | 0.25 | — | — | — | 0.4 |
| 6 | 0.25 | 0.2 | — | — | — |

*DMU is dimethylourea

Swatches of Nylon 6 tricot jersey, style 322 from Test Fabrics Inc. were dipped into the test solutions. The dipped swatches were then handpressed between a plate and aluminum foil and air dried for 50 minutes. The dried swatches were then annealed for 30 minutes at 120° C. in an air circulating oven. Using the procedure of AATCC Test Method 118-1966, the oil repellency of each swatch was evaluated initially and after being subjected to a number of laundry cycles.

This test is designed for detecting the presence of a fluorochemical finish, or other compounds capable of imparting a low surface energy, on all types of fabrics, by evaluating the fabric's resistance to wetting by a selected series of liquid hydrocarbons of different surface tensions.

In practice, the test fabric specimen is placed on a flat, smooth, horizontal surface. Beginning with the lowest-number test liquid (AATCC oil repellency No. 1, Nujol), carefully place a small drop (approximately 3/16" diameter of 0.05 mL volume) using a pipette or eye dropper on the fabric surface. Observe the drop for 30 seconds, from approximately a 45° angle. If no penetration or wetting of the fabric at the liquid-fabric interface and no wicking around the drop occurs, place a drop of the next higher-number test liquid at an adjacent site on the fabric and again observe for 30 seconds. Wetting of the fabric is normally evidenced by a darkening of the fabric at the liquid-fabric interface. On some fabrics, wetting can be detected by loss of "sparkle" within the drop. The AATCC Oil Repellency Rating of a fabric is the highest-number test liquid which will not wet the fabric within the thirty second period.

| | Test Liquids | |
|---|---|---|
| AATC Oil Repellency Rating | Composition | Surface Tension |
| 1 | Nujol | 32.8 |
| 2 | 65:35 Nujol N-hexadecane by volume @ 70° F. | 31.1 |
| 3 | N-hexadecane | 28.0 |
| 4 | N-tetradecane | 26.7 |
| 5 | N-dodecane | 25.4 |
| 6 | N-decane | 24.0 |
| 7 | N-octane | 21.8 |
| 8 | N-heptane | 20.0 |

The laundry stability of a modified fabric surface is determined by observing the decline in AATCC Oil Repellency Rating during repeated home laundry cycles. It was arbitrarily decided that an oil repellency rating less than 4 was not commercially acceptable. As a means of comparison, the oil repellency is plotted versus the number of laundry cycles. This allows comparison among different additive structures, differences in annealing conditions, etc.

After determining the oil repellency of the fabric surface, the fabric is subjected to a typical home laundry operation. A Sears, Kenmore, heavy duty 6-cycle washing machine with a self cleaning filter is used in the 12 minute hot (105° C.) wash cycle and a double hot rinse. The detergent used is one cup of Dash and 3 lbs. of cotton laboratory coats are used as ballast. The test specimens only are dried in a Sears, Kenmore, Soft Heat, electric dryer using a thirty minute drying period with temperature fluctuations between 50° and 80° C. in heater cycle.

The test specimens are not ironed before oil repellencies are determined and subsequently the fabric surfaces become "fuzzier" as the number of laundry cycles increase. For this reason, oil repellencies may decrease with number of laundry cycles and not necessarily indicate the removal of fluorocarbon from the fabric surface.

The results of the test are set forth in the following Table II.

TABLE II

| Cycles | 1 | 2 | 3 | 4 | 5 | 6 |
|---|---|---|---|---|---|---|
| 0 | 7 | 7 | 7 | 7 | 7 | 7 |
| 1 | 7 | 7 | 6 | 7 | 1 | 7 |
| 2 | 6 | 6 | 6 | 6 | 0 | 6 |
| 3 | 5 | 6 | 6 | 6 | — | 6 |
| 4 | 2 | 6 | 6 | 6 | — | 5 |
| 5 | — | 5 | 5 | 5 | — | 3 |
| 6 | — | 3 | 5 | 4 | — | 1 |
| 7 | — | 2 | 2–3 | 1 | — | — |

EXAMPLE II

Various test compositions of this invention containing 0.2 and 0.4 grams of RD-27 novolac in methanol were prepared. For comparison, test compositions containing the same amounts of Intratex oligomers, a commercially available anti-staining agent available from Crompton Knowles Corporation were also formulated. Sleaves knitted from commercial carpet fibers were dip coated with the test solutions and annealed at 120° C. for 30 minutes. Certain of the fibers were pretreated with DSR. The samples are set forth in the following Table II.

TABLE II

| Sample No | DSR | RD-27 | Intratex |
|---|---|---|---|
| II(1)a | – | 0.4 | — |
| II(2)b | + | 0.4 | — |
| II(3)c | – | — | 0.4 |
| II(4)d | + | — | 0.4 |
| II(5)e | – | 0.2 | — |
| II(6)f | + | 0.2 | — |
| II(7)g | – | — | 0.2 |
| II(8)h | + | — | 0.2 |

Various staining solutions were formulated. Staining solution A was prepared by dissolving 0.45 grams of unsweetened cherry Kool Aid in one liter of water and staining solution B was prepared by in a commercial automatic coffee maker. The test fabric is taped to a rigid, impervious surface as for example a section of a photographic plate. The test fabric is placed over a 10 mL beaker containing 2 mL of the staining solution at room temperature. Inversion with shaking allows the staining solution to contact the test surface for a period of one minute. At the end of this time, it is again inverted which allows unabsorbed staining solution to drain back into the beaker. Immediately, the test surface is blotted with paper towels to remove any staining solution entrapped in fiber bundles. This procedure is repeated on fresh areas of the fabric surface for one, two and five minute periods. The oil repellency of the test fabric is also determined using the test procedure of AATCC Test Method 118-1966 as described in Example I. After determining the stain repellency of the fabric surface, the fabric is subjected to typical home laundry operations. A Sears, Kenmore, heavy duty 6-cycle washing machine with a self-cleaning filter is used in the 12 minute hot (105° F.) wash cycle and a double hot rinse. The detergent used is one cup of Dash and 3 lbs of cotton laboratory coats are used as ballast. The test specimens only are dried in a Sears, Kenmore, Soft Heat, electric dryer using a thirty minute drying period with temperature fluctuations between 50° and 80° C. in heater cycles.

The test specimens are not ironed before again testing for stain resistance.

The results of these tests are set forth in the Following Table III. In Table III, the abbreviations have the following meanings:

(a) "A" is no stain.
(b) "B" is trace stain.
(c) "C" is pale stain.
(d) "D" is bright stain.
(e) "E" is medium stain.
(f) "F" is heavy stain.
(g) "G" is intense stain.
(h) "OP" is oil repellency using the rating system in Example I.

TABLE III

| Expt No. | Sample No. | Solution A 1 min | Solution A 2 min | Solution A 5 min | Solution B 1 min | Solution B 2 min | Solution B 5 min | OP |
|---|---|---|---|---|---|---|---|---|
| | | | After First Stain | | | | | |
| II(a) | II(1) | D | D | E | F | E | F | 0-1 |
| II(b) | II(2) | A | A | A | B | B | L-F | 4-5 |
| II(c) | II(3) | B-C | C | E | F | F | F | 0-1 |
| II(d) | II(4) | A | A | A | B | E | E-F | 1-2 |
| II(e) | II(5) | A | A | D | F | F | F | 0 |
| II(f) | II(6) | A | A | B | B | D | E | 3-4 |
| II(g) | II(7) | D | D | E | F | F | F | 0-1 |
| II(h) | II(8) | A | A | B | D | F | E-F | 1-2 |
| | | | After First Wash | | | | | |
| II(a) | | A | A | A | A | A | A | 0 |
| II(b) | | A | A | A | A | A | A | 1 |
| II(c) | | A | B | D | B | A | B | 0-1 |
| II(d) | | A | A | A | A | A | A | 1-2 |
| II(e) | | A | A | A | A | A | A | 0 |
| II(f) | | A | A | A | A | A | A | 2 |
| II(g) | | A | A | A | B | B | B | 0-1 |
| II(h) | | A | A | A | B | B | B | 2 |
| | | | After Second Stain | | | | | |
| II(a) | | D | D-E | D | F | F | F | 0 |
| II(b) | | A | A | B | D | D | D-F | 2-3 |
| II(c) | | F | F | F | F | F | F | 0 |
| II(d) | | B | B | D | D | F | E-F | 2 |
| II(e) | | D | D-E | F | F | F | F | 0 |
| II(f) | | A | A | B | D-E | D-E | E-F | 2 |
| II(g) | | F | F | F | F | F | F | 0 |
| II(h) | | B | B | E | D | E-F | E-F | 2 |
| | | | After Second Wash | | | | | |
| II(a) | | B | D | A | D | D | D | 0 |
| II(b) | | A | A | A | A | A | A | 1 |
| II(c) | | E-F | E-F | F | E | E | E | 0 |
| II(d) | | A | A | B | D | D-E | D-E | 1 |
| II(e) | | A | D | E | B | B | B | 0 |
| II(f) | | A | A | A | A | A | B | 2 |
| II(g) | | E-F | E-E | F | E | E | E | 0 |
| II(h) | | B | B | D | D | E | E-F | 1-2 |
| | | | After Third Stain | | | | | |
| II(a) | | E | E | E | F | F | F | 0 |
| II(b) | | B | D | D | D | E | F | 1-2 |
| II(c) | | — | — | — | — | — | — | — |

TABLE III-continued

| Expt No. | Sample No. | Solution A 1 min | Solution A 2 min | Solution A 5 min | Solution B 1 min | Solution B 2 min | Solution B 5 min | OP |
|---|---|---|---|---|---|---|---|---|
| II(d) | | B | C | D-E | D | E-F | E-F | 1 |
| II(e) | | E | E | E-F | F | F | F | 0 |
| II(f) | | B | D | E | D | E | E-F | 2 |
| II(g) | | — | — | — | — | — | — | — |
| II(h) | | C | E | E-F | E | E | F | 2 |
| | | | After Third Wash | | | | | |
| II(a) | | D | D | D | D | D | D | 0 |
| II(b) | | A | A | B | B | B | D | 1 |
| II(c) | | — | — | — | — | — | — | — |
| II(d) | | A | B | D | D | E | E | 0-1 |
| II(e) | | B | E | E | D | D | E | 0 |
| II(f) | | A | A | B | B | B | B | 1-2 |
| II(g) | | — | — | — | — | — | — | — |
| II(h) | | A | D | E-F | D | D-E | E | 0-1 |

EXAMPLE III

Using the procedure of Examples I and II, the efficacy of the compositions of this invention are anti-staining and oil repelling agent were involved. The test compositions are set forth in the following Table IV. In the Table, the abbreviations have the following definitions.

(a) "M" is methanol
(b) "A" is acetane
(c) "I" is isoproponal
(d) "T" is TINUVIN P a UV light absorber marketed and sold by Ciba-Geigy Corporation.

TABLE IV

| Sample No. | T | DSR | RD-27 | Components Intratex[r] | Components Solvent |
|---|---|---|---|---|---|
| II(1) | — | — | — | 0.4% | M |
| II(2) | — | — | — | 0.4% | M |
| II(3) | — | 0.15% | 0.4% | — | M |
| II(4) | — | 0.15% | 0.4% | — | A |
| II(5) | — | 0.15% | 0.2% | — | A |

TABLE IV-continued

| Sample No. | T | DSR | RD-27 | Components Intratex[r] | Components Solvent |
|---|---|---|---|---|---|
| II(6) | — | 0.15% | 0.1% | — | A |
| II(7) | — | 0.25% | — | 0.4% | M/I |
| II(8) | 0.05% | 0.15% | 0.2% | — | A |
| II(9) | 0.2% | 0.25% | 0.4% | — | A |
| II(10) | 0.2% | 0.15% | 0.4% | — | A |
| II(11) | 0.1% | 0.15% | 0.4% | — | A |

The fabric was dip coated with the sample solutions and annealed for 30 minutes 120° C. and the staining and oil repellancy of the treated fabric was determined using the procedures of Examples I and II. The results of the evaluation are set forth in attached Table V.

For comparison purposes, the staining and oil repellancy characteristics of fabrics which had been pretreated with DSR prior to treatment with 0.4% Intratex Oligomer and RD-27 novalac were evaluated. Results of this evaluation are also set forth in Table IV in experiments C(1) and C(2).

TABLE V

| Expt No. | Sample No. | Solution A 1 min | Solution A 2 min | Solution A 5 min | Solution B 1 min | Solution B 2 min | Solution B 5 min | OP |
|---|---|---|---|---|---|---|---|---|
| | | | After First Stain | | | | | |
| III(a) | III(1) | C | D | D | E | F | F | 0 |
| III(b) | III(2) | C | D | D | E | E | E | 0 |
| III(c) | III(3) | C | D | E-F | D | D | D-E | 6 |
| III(d) | III(4) | A | A | E | D | E | F | 5 |
| III(e) | III(5) | B | D | E | B | D | D | 5 |
| III(f) | III(6) | D | D-E | B | B | D | E | 5 |
| III(g) | III(7) | A | A | A | D | D | E-F | 5 |
| III(h) | III(8) | A | A | A | D | D | D-E | 5 |
| III(i) | III(9) | A | D | C | D | D | E | 6 |
| III(j) | III(10) | A | B | D | D | D | E | 6 |
| III(k) | III(11) | A | B | | D | D | E | 6 |
| C(1) | III(1) | A | B | A | D | E | E | 2 |
| C(2) | III(2) | A | A | B | D | B | E | 2-3 |
| | | | After First Wash | | | | | |
| III(a) | | B | C | C | D | D | D | 0 |
| III(b) | | A | B | C | A | A | A | 0 |
| III(c) | | B | C | E-F | A | A | B | 6 |
| III(d) | | A | A | A | A | A | A | 5 |
| III(e) | | B | B | E | A | B | D | 5 |
| III(f) | | A | B | D | A | A | B | 5 |
| III(g) | | A | A | A | A | A | A | 0 |
| III(h) | | B | C | D | A | A | A | 4 |
| III(i) | | A | A | B | A | A | A | 6 |
| III(j) | | A | A | B | A | A | A | 6 |
| III(k) | | A | B | D | A | A | A | 5-6 |
| C(1) | | A | A | A | A | A | B | 5 |
| C(2) | | A | A | A | A | A | A | 2 |
| | | | After Second Stain | | | | | |
| III(a) | | — | — | — | — | — | — | — |
| III(b) | | — | — | — | — | — | — | — |

TABLE V-continued

| Expt No. | Sample No. | Solution A 1 min | Solution A 2 min | Solution A 5 min | Solution B 1 min | Solution B 2 min | Solution B 5 min | OP |
|---|---|---|---|---|---|---|---|---|
| III(c) | | — | — | — | — | — | — | — |
| III(d) | | A | B | D | A–E | E | E | 5 |
| III(e) | | D | D–E | F | D | E–F | F | 5 |
| III(f) | | B | D–E | E–F | D–F | E | E–F | 5 |
| III(g) | | F | F | F | F | F | F | 0 |
| III(h) | | — | — | — | — | — | — | — |
| III(i) | | B | D | E | D | D | E–F | 6 |
| III(j) | | B | D | E | D | E | F | 5 |
| III(k) | | B | D | E–H | E | F | F | 5 |
| C(1) | | — | — | — | — | — | — | — |
| C(2) | | — | — | — | — | — | — | — |
| | | | After Second Wash | | | | | |
| III(a) | | — | — | — | — | — | — | — |
| III(b) | | — | — | — | — | — | — | — |
| III(c) | | — | — | — | — | — | — | — |
| III(d) | | A | A | B | A | B | B | 5 |
| III(e) | | D | D | E | A | D | D | 3–4 |
| III(f) | | B | D–E | E–F | A | D | D | 4 |
| III(g) | | E–F | E–F | E–F | E | E | E | 0 |
| III(h) | | — | — | — | — | — | — | — |
| III(i) | | B | B | E | B | B | E | 5 |
| III(j) | | B | B | E | B | B | D | 4–5 |
| III(k) | | B | D | E | D | E | E | 5 |
| C(1) | | — | — | — | — | — | — | — |
| C(2) | | — | — | — | — | — | — | — |
| | | | After Third Stain | | | | | |
| III(a) | | — | — | — | — | — | — | — |
| III(b) | | — | — | — | — | — | — | — |
| III(c) | | — | — | — | — | — | — | — |
| III(d) | | B | D | D | D–F | D–E | D–E | 4–5 |
| III(e) | | — | — | — | — | — | — | — |
| III(f) | | — | — | — | — | — | — | — |
| III(g) | | — | — | — | — | — | — | — |
| III(h) | | — | — | — | — | — | — | — |
| III(i) | | — | — | — | — | — | — | — |
| III(j) | | — | — | — | — | — | — | — |
| III(k) | | — | — | — | — | — | — | — |
| C(1) | | — | — | — | — | — | — | — |
| C(2) | | — | — | — | — | — | — | — |
| | | | After Third Wash | | | | | |
| III(a) | | — | — | — | — | — | — | — |
| III(b) | | — | — | — | — | — | — | — |
| III(c) | | — | — | — | — | — | — | — |
| III(d) | | A | B | D | B | B | B | 5 |
| III(e) | | — | — | — | — | — | — | — |
| III(f) | | — | — | — | — | — | — | — |
| III(g) | | — | — | — | — | — | — | — |
| III(h) | | — | — | — | — | — | — | — |
| III(i) | | — | — | — | — | — | — | — |
| III(j) | | — | — | — | — | — | — | — |
| III(k) | | — | — | — | — | — | — | — |
| C(1) | | — | — | — | — | — | — | — |
| C(2) | | — | — | — | — | — | — | — |

What is claimed is:

1. A process for imparting stain resisting properties to fibers formed from thermoplastic polymers, said process comprising:

(a) treating said fibers with a composition comprising an effective carrier and a stain resisting effective amount of one or more condensation products of the Formula I:

$$P—Z—X\!\!\downarrow\!\!-Z—X\!\!\downarrow\!\!-Z—P; \qquad \text{Formula I}$$

and (b) annealing said treated fiber; wherein:

Z is a divalent moiety of the formulas:

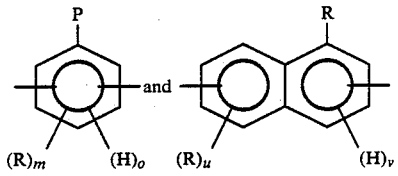

wherein:

P is a hydrogen, —OH or a moiety of the formula —X— OH;

m and o are the same or different and are positive whole numbers from 0 to 3 with the proviso that the sum of o and m at each occurrence is equal to 3;

u and v are the same or different at each occurrence and are positive whole numbers from 0 to 5 with the proviso that the sum of u and v at each occurrence is 5;

—X— is a divalent organic radical;

R is the same or different at each occurrence and is selected from the group consisting of alkyl, aryloxy, alkoxy, aryl, hydroxy, and methylol; and n is a positive whole number.

2. A process according to claim 1 wherein said composition comprises a phenol condensation product of Formula I.

3. A process according to claim 2 wherein X is substituted or unsubstituted methylene or 1,4-phenyldimethylene, wherein permissible substituents are alkyl having from 1 to about 10 carbon atoms, halogen, and furyl.

4. A process according to claim 3 wherein X is a moiety of the formula:

$$-\overset{|}{C}HR_1$$

where $R_1$ is hydrogen or alkyl.

5. A process according to claim 2 wherein n is from 1 to about 10.

6. A process according to claim 5 wherein n is from 1 to about 4.

7. A process according to claim 2 wherein:

m is 0 or 1; and o is 2 to 3.

8. A process according to claim 7 wherein:

m is 0; and o is 3.

9. A process according to claim 2 wherein R is alkyl.

10. A process according to claim 9 wherein R is methyl or ethyl.

11. A process according to claim 2 which further comprises treating said fiber with one or more other fiber-treating agents.

12. A process according to claim 11 wherein said other fiber-treating agent is an anti-soiling agent.

13. A process according to claim 12 wherein said anti-soiling agent is selected from the group consisting of compounds having the formula:

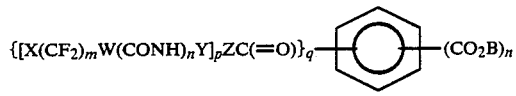

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms: $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the active general formulas are the same or different; said compound being capable, upon contact thereof-as a solution or dispersion-with fibers of polyethylene terephthalate or of nylon and heating, of imparting water and oil repellency to such fibers.

14. A process of claim 13 being a trimellitate, a pyromellitate, of a bis(N-N-disubstituted amide)/ester of trimellitic acid or of pyromellitic acid, wherein each fluorinated radical, of formula $X(CF_2)_mW(CONH)_mY$, has a main chain contacting at least six carbon atoms and contains at least four perfluorinated carbon atoms in the radical.

15. A process according to claim 14 wherein the fluorinated moiety in said fluorinated radicals has formula $CF_3(CF_2)_m$ or $(CF_3)_2CFO(CF_2)_m$; m having independently at each occurrence any value from 5 to 9 and m having independently at each occurrence any value from 5 to 9 and m having independently at each occurrence any value from 2 to 16, $(CF_2)_m$ and $(CF_2)_m$ being straight chains; and wherein said B radicals are $CH_2CH_2OH$, $CH_2CH(OH)CH_2Cl$, $CH_2CH(OH)CH_2OH$ or $CH_2CH(OH)CH_2Br$.

16. A process according to claim 14 being a mixture of para and meta substituted pyromellitic acid position isomers wherein overall the two fluorinated raidcals have the same formula and the two radicals B have the same formula.

17. A process according to claim 13 wherein said compound is a pyromellitate; wherein said fluorinated radicals have formula $CF_3(CF_2)_mCH_2CH_2$— with m being independently at each occurrence an integer from 2 to 16; wherein —$(CF_2)_m$— and —$(CF_2)_m$— are straight chains; and wherein said B radicals have formula $CH_2CH_2OH$, $CH_2CH(OH)CH_2Cl$, $CH_2CH(OH)CH_2OH$ or $CH_2CH(OH)CH_2Br$.

18. A process according to claim 17 wherein said pyromellitate is the metal isomer and m is 5 to 9 or m is 2 or 4.

19. A process according to claim 12 wherein said other fiber-treating agent is selected from the group consisting of oligomer containing mixtures produced by a process which comprises:

(a) reacting pyromellitic dianhydride with fluorinated alcohol at a mole ratio of fluorinated alcohol to pyromellitic dianhydride between about 1:0,55 and about 1:1.0 to form a partially esterfied product having fluorinated ester groups, free acid groups and anhydride groups; and (b) reacting the partially esterfied product with an oxirane compound selected from the group consisting of epichlorohydrin, epibromohydrin and propylene oxide in an amount sufficient to cause essentially all of the free acid groups and anhydride groups to be esterfied.

20. A process according to claim 19 wherein said fluorinated alcohol is of the formula: $CF_3(CF_2)_pR'OH$ wherein R' is alkylene of 2–6 carbons and p is an integer of 3–15.

21. A process according to claim 20 wherein said fluorinated alcohol is a mixture of compounds of the formula $CF_3CF_2(CF_2CF_2)_nCH_2CH_2OH$ with n being from 1 to 6.

22. A process according to claim 21 wherein n is from 2 to 5.

23. A process according to claim 19 wherein said mole ratio is between about 1:0.6 and about 1:0.85.

24. A process according to claim 19 wherein said mole ratio is between about 1:0.65 and about 1:0.75.

25. A process according to claim 21 wherein said other fiber-treating agent is selected from the group consisting of oligomeric compounds produced by a process comprising:

(a) reacting pyromellitic dianhydride with fluorinated alcohol at a mole ratio of about two moles of fluorinated alcohol per mole of pyromellitic dianhydride to produce a pyromellitate having two fluorinated ester moieties and two carboxylic acid moieties;

(b) reacting said pyromellitate of step (a) with an excess of an oxirane compound selected from the group consisting of epichlorohydrin, epibromohydrin, and propylene oxide in the presence of additional pyromellitic dianhydride to produce said organic mixture comprising oligomeric compounds; wherein said oxirane compounds react with said carboxylic acid moieties to produce an ester having a primary or secondary alcohol, and wherein said alcohol reacts with said additional pyromellitic dianhydride to produce ester-linking moieties and carboxylic acid moieties capable of reacting with said oxirane compound to produce additional esters having primary or secondary alcohols.

26. A process according to claim 25 wherein said excess pyromellitic dianhydride is added to a reaction medium in said step (b) when about 50% to about 100% of the carboxylic acid moieties have been esterified.

27. A process according to claim 26 wherein said excess pyromellitic dianhydride is added to a reaction medium in said step (b) when about 85% to about 95% of the carboxylic acid moieties have been esterfied.

28. A process according to claim 25 wherein said additional pyromellitic dianhydride is added to a reaction medium in said step (b) simultaneously with the oxirance compound.

29. The process of claim 25 wherein said fluorinated alcohols is of the formula: $CF_3(CF_2)_pR'OH$ wherein R' is alkylene of 2–6 carbons and p is an integer of 3–15.

30. A process according to claim 1 which further comprises annealing said treated fiber by heating at a temperature above the glass transition temperature of the thermoplastic polymer forming said fiber and below the degradation temperature of the thermoplastic polymer forming said fiber and the condensation products.

31. A process according to claim 30 wherein said treated fiber is heated at a temperature of from about 100° C. to about 220° C.

32. A process according to claim 11 wherein said treating steps are carried out sequentially.

33. A process according to claim 32 wherein said treating steps are carried out simultaneously.

34. A process according to claim 1 wherein said fibers are formed from a polyester or a polyamide.

35. A process according to claim 34 wherein said fiber is formed from a polyamide.

36. A process according to claim 35 wherein said polyamide is selected from the group consisting of nylon 6 and nylon 66.

37. A process according to claim 35 wherein said polyamide is nylon 6.

* * * * *